United States Patent [19]

Marthaler et al.

[11] 3,963,492

[45] June 15, 1976

[54] METHOD FOR PROCESSING SILVER DYE BLEACH MATERIALS

[75] Inventors: Max Marthaler; Matthias Schellenberg; Herbert Mollet; Christoph Chylewski, all of Marly, Switzerland

[73] Assignee: Ciba-Geigy AG, Basel, Switzerland

[22] Filed: Oct. 1, 1974

[21] Appl. No.: 510,967

[30] Foreign Application Priority Data

Oct. 12, 1973 Switzerland ..... 14531/73

[52] U.S. Cl. ..... 96/53; 96/20

[51] Int. Cl.[2] ..... G03C 7/00

[58] Field of Search ..... 96/53, 20

[56] References Cited

UNITED STATES PATENTS

| | | | |
|---|---|---|---|
| 2,322,084 | 6/1943 | Young et al. | 96/53 |
| 3,620,744 | 11/1971 | Schellenberg et al. | 96/20 |
| 3,796,576 | 3/1974 | Schlunke et al. | 96/53 |
| 3,868,253 | 2/1975 | Marthaler et al. | 96/53 |

*Primary Examiner*—J. Travis Brown

*Attorney, Agent, or Firm*—Joseph G. Kolodny; Edward McC. Roberts; Prabodh I. Almaula

[57] ABSTRACT

The present invention relates to a simplified method for processing silver dye bleach material by (1) silver developing, (2) dye and silver bleaching (3) silver fixing and (4) soaking. The sequence (1), (2), (3), (4) is followed and the bleaching bath (2) contains (a) a strong acid, (b) a water-soluble iodide, (c) a water-soluble oxidizing agent (d) an antioxidant and (e) a dye bleach catalyst.

10 Claims, No Drawings

METHOD FOR PROCESSING SILVER DYE BLEACH MATERIALS

The simplification, and frequently also the shortening, of photographic processing methods plays a constantly increasing role in modern industry. Thus, in copying establishments, the immediate production of an image with fewest possible processing steps after exposure is desired, and is also finding constantly increasing acceptance in photographic practice. In particular, rapid processing in automatic machines is meeting increasing interest. Thus, attempts are made to reduce the duration of the individual processing steps by increasing the processing temperature and by adding accelerators. In the case of colour materials, where, as a rule, a larger number of processing steps or processing stages has to be carried out, constantly increasing attempts are made to reduce the duration of the total process by combining two or more processing steps. This approach additionally offers the advantage that the processing machines can be simplified and cheapened, by reducing the number of liquid tanks.

This general tendency exists for all photographic materials. It is of particular interest in the case of colour materials which are processed by the silver dye bleach method. The high quality of the images in general has to be acquired at the expense of a complicated and lengthy processing method. Such colour materials are described, for example, in DT-OS 2,128,801, DT-AS 1,547,759 and DT-AS 1,547,720. The conventional processing method for such materials comprises 10 stages and is described, for example, in DT-OS 1,472,811 and 1,924,723, and also in textbooks, such as, for example, E. Mutter: farbphotographic und Praxis (Colour Photography and Practice) (Springer, 1967), page 57.

In the silver dye bleach method, certain process steps, especially the dye bleach stage, demand particular care. An image which is satisfactory in respect of colour equilibrium, natural reproduction and satisfactory contrast is as a rule only obtained if certain instructions relating to the composition of the bath and to the temperature and duration of processing are followed exactly. Similarly to the case of other colour processes, a significant influence of the duration of utilisation of the bath is also detectable, that is to say after producing a major number of images it is possible, inter alia, for progressive deterioration of the image quality, for example deterioration of the white part of the image, or other changes, to occur. Such changes occur through consumption of important chemicals, through oxidation by air, through entrainment of chemicals from one bath into another, or through accumulation of reaction products of the process itself. In addition to the simplification and shortening of the processing method, it is therefore a further important objective to render the process less sensitive to external influences and thereby not only to achieve a reliable an constant result, which persists for a prolonged period, but also to achieve better utilisation of the chemicals and a reduction in the amount of water consumed.

There has hitherto been no lack of attempts to achieve the objectives described above. Thus, for example, German Patent Specification No. 735,672 has proposed reducing the number of process steps to four by combining four treatment stages, namely the fixing of the undeveloped silver halide, the dye bleaching, the slver bleaching and the fixing of the oxidised image silver in a sngle treatment bath, and this of course not only dispenses with the three process steps of the conventional method which have been saved, but also with the corresponding three intermediate soakings. To remove the unconverted slver halide and the oxidised image silver, the patent specification mentioned proposes ligands which form water-soluble silver complexes which can easily be washed out of the layers during the final soaking. In particular, ammonium thiocyanate and thiourea are proposed for this purpose.

However, it is known that ammonium thiocyanate is not stable in strongly acid baths, such as are essential for dye bleaching, and decomposes, with formation of a yellowish precipitate and evolution of hydrogen cyanide. Furthermore it is known that thiourea is toxic and that it can have a corrosive action in conjunction with strong acids. It is also known that if small amounts of thiourea pass into the developing bath, these result in deterioration of the development. In the automatic processing machines frequently used nowadays there is always a certain danger of reverse entrainment of chemicals. It can therefore happen that the activity of the silver developing bath is endangered by a subsequent bath containing thiourea. A further disadvantage of the use of ligands which form water-soluble complexes is the necessary accumulation of water-soluble silver complexes in the combined bleach-fixing bath, which can also impair the bleaching action if the bath is used for a prolonged period.

A reduction in the number of process steps is also described in DT-OS 2,309,526. There, it is proposed to combine the slver bleach stage with the fixing bath to a combined bleach-fixing bath. Thiourea is here again proposed as the silver ligand, which necessarily gives the same disadvantages as in the process according to the abovementioned German Patent Specification No. 735,672.

Finally, a further embodiment of the silver dye bleach process, in which several process steps can be saved, is described in German Patent Specification No. 1,547,759. According to this process, which is particularly suitable for processing silver dye bleach material is self-developing cameras, the material, which has been exposed and been developed with an activator solution in accordance with the known process, is brought into contact with a sheet which contains a silver ligand which forms water-soluble complexes, and an acid ion exchanger which releases hydrogen ions.

The lowering of the pH resulting from the ion exchanger then initiates the dye bleaching. Here again, the use of silver ligands which form water-soluble complexes is essential.

It has now been found that a shortened processing method for silver dye bleach materials can be arrived at by another route, in which it is possible to dispense with the use of silver ligands which form soluble complexes, and the abovementioned disadvantages are therefore avoided. In processes according to the invention, the dye bleach stage and the silver bleach stage are grouped together to a single combined bath and the fixing stage, in which the entire silver halide is rendered soluble by complex formation, is separated therefrom. As a result it is possible to use, in the combined dye bleach and silver bleach stage, a silver ligand which forms sparingly water-soluble complexes, as a result of which the disadvantages of the known processes can be eliminated. In the process according to the invention, the combined bleaching stage furthermore uses a dye bleach catalyst in a high concentration, and a water-soluble oxidising agent and an anti-oxidant.

Accordingly, the present invention relates to a method for processing silver dye bleach materials, comprising the following process measures 1. silver developing,
2. dye bleaching and silver bleaching,
3. silver fixing and
4. soaking.

The process is characterised in that using treatment baths corresponding to the treatment stages (1) to (4), and following the sequence (1) to (4), a bleaching bath (2) is used, for the combined dye bleaching and slver bleaching, which contains a. a strong acid,
b. a water-soluble iodide,
c. a water-soluble oxidising agent,
d. an anti-oxidant and
e. a dye bleach catalyst, preferably in an amount of 0.5 to 5 g per liter, and that the entire processing, from entry into the first bath (1) to leaving the last bath (4) takes place at temperatures from 20° to 90°C.

Accordingly the method only requires a short time, which is above all important when producing instant images in automatic installations. It can be carried out, with good results, in such a way that the entire processing from introduction into the first bath (1) to leaving the last bath lasts at most 6 minutes and the dwell time in the individual baths is at most 2 minutes.

For the silver developing (1), it is possible to use baths of customary composition, for example those which contain hydroquinone and optionally additionally 1-phenyl-3-pyrazolidone as the developer substance. As will still be explained in more detail, it is advantageous if the silver developing bath contains a dye bleach catalyst.

It has been found, surprisngly, that using a combined bleach bath of the indicated composition exceptionally short bleaching times can be achieved and at the same time good image contrasts and a natural colour reproduction are obtained. A further advantage of the process is the high stability of the combined bleach bath and its low sensitivity to entrained developer solution. An intermediate soaking between the silver developing stage and the combined bleach bath is therefore unnecessary and in spite of this saving, images of constant good quality are obtained for a long period without regenerating the bath. The combined bleach bath to be used according to the invention is furthermore distinguished by very low corrosiveness. It is therefore possible to use such a bath in developing machines in which parts made from high quality stainless steel come into contant contact with the bleach liquid. Under these conditions, neither are the machine parts attacked nor is the activity of the bath impaired by heavy metal ions migrating into the bath.

Furthermore, it has been found that a combined bleach bath according to the present invention is far less critical with regard to treatment duration and treatment temperature than a dye bleach bath operating according to the conventional process. Whilst in the case of the customary dye bleach process the image reproduction depends to a high degree on the temperature and duration of treatment with the dye bleach bath, a constant result is obtained in a combined bleach bath according to the invention, even if the duration of treatment and temperature of the bath are varied within wide limits. Such a process is therefore not only suitable for machine processing but can also be employed successfully, without complication, by an amateur photographer who does not possess any mechanised equipment.

According to the invention, the iodide ion is used as the silver ligand, which forms sparingly soluble complexes, in the combined dye bleach bath and silver bleach bath. The known disadvantage of difficulty of fixing of the silver iodide can largely be compensated through suitable composition of the fixing bath, without losing an important advantage of the processing method, namely its short total duration.

Catalysts selected from the series of the known bleach catalysts are preferably those which have a low intrinsic coloration and exert a powerful bleaching action. Furthermore it is advantageous to use those catalysts which are readily soluble both in the alkaline silver developing bath and in the acid bleach bath. This makes it possible, as has been described in German Patent Specification No. 1,190,788, to add a part of the catalyst already to the silver developing bath, as a result of which the time of treatment with the combined bleach bath can be reduced further and its activity can be maintained for a long period even without intermediate soaking and regeneration. Accordingly it is in general also advantageous to add the same dye bleach catalyst to the silver developing bath and the combined bleach bath.

Examples of suitable catalysts are pyrazine compounds and preferably quinoxaline compounds, above all those which are substituted in the 2-, 3-, 5-, 6- or 7-positioned by methyl groups, methoxy groups or acylated or non-acylated hydroxymethyl groups or by acylated or nonacylated amino groups. The table which follows shows a selection of suitable bleach catalysts. Quinoxaline compounds of the formula (I)

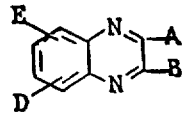

(Ac denotes —CO—$CH_3$)

TABLE

| A | B | D | E |
|---|---|---|---|
| —$CH_3$ | —CH(OH)—$CH_3$ | —H | —H |
| —$CH_2OH$ | —$CH_2OH$ | 6-$OCH_3$ | 7-NH—CO—$CH_3$ |
| —$CH_2OAc$ | —$CH_2OAc$ | 6-$OCH_3$ | 7-NH—CO—$CH_3$ |
| —$CH_2Cl$ | —$CH_2Cl$ | 6-OH | —H |
| —$CH_2OH$ | —$CH_2OH$ | 6-$OCH_3$ | 7-$NH_2$ |
| —$CH_2OH$ | —$CH_2OH$ | 5-$OCH_3$ | 6-Cl |
| —$CH_2OH$ | —$CH_2OH$ | 5-Cl | 6-$OCH_3$ |

TABLE-continued

| A | B | D | E |
|---|---|---|---|
| $-CH_2OAc$ | $-CH_2OAc$ | $5\text{-}OCH_3$ | $6\text{-}OCH_3$ |
| $-CH_2OAc$ | $-CH_2OAc$ | 5-Cl | $6\text{-}OCH_3$ |
| $-CH_3$ | $-CH_3$ | $5,6\text{-}O-CH_2-O-$ | |
| $-CH_2OH$ | $-CH_2OH$ | $6,7\text{-}O-CH_2-CH_2-O$ | |
| $-CH_2-OC_2H_5$ | $-CH_2OC_2H_5$ | $6\text{-}OCH_3$ | $-H$ |
| $-CH_2-OCH_3$ | $-CH_2-OCH_3$ | $-H$ | $-H$ |
| $-CH_2OH$ | $-CH_2OH$ | $5\text{-}OCH_3$ | $-H$ |
| $-CH_2OH$ | $-CH_2OH$ | $6\text{-}OCH_3$ | $-H$ |
| $-CH_2OH$ | $-CH_2OH$ | $6\text{-}OCH_3$ | $7\text{-}OCH_3$ |
| $-CH_2OH$ | $-CH_2OH$ | $-H$ | $-H$ |
| $-CH_2OAc$ | $-CH_2OAc$ | $5\text{-}OCH_3$ | $-H$ |
| $-CH_2OAc$ | $-CH_2OAc$ | $6\text{-}OCH_3$ | $-H$ |
| $-CH_2OAc$ | $-CH_2OAc$ | $6\text{-}OCH_3$ | $7\text{-}OCH_3$ |
| $-C_6H_5$ | $-C_6H_5$ | $6\text{-}SO_3H$ | $-H$ |
| $-CH_3$ | $-CH_3$ | $5\text{-}CH_3O$ | $8\text{-}CH_3$ |
| $-CH_2OAc$ | $-CH_2OAc$ | $-H$ | $-H$ |
| $-CH_3$ | $-CH_3$ | $6,7\text{-}O-CH_2-CH_2-O-$ | |
| $-CH_2OH$ | $-CH_2OH$ | $6,7\text{-}O-CH_2-O-$ | |
| $-CH_3$ | $-CH_3$ | $-CH_3$ | $-CH_3$ |
| $-CH_3$ | $-CH_3$ | 6-Cl | $-H$ |
| $-CH_3$ | $-CH_3$ | 5-OH | $-H$ |
| $-CH_3$ | $-CH_3$ | 5-OH | 8-OH |
| $-CH_2OAc$ | $-CH_2OAc$ | $6,7\text{-}O-CH_2-CH_2-O-$ | |
| $-CH_2OAc$ | $-CH_2OAc$ | $6,7\text{-}O-CH_2-O-$ | |
| $-CH_3$ | $-CH_3$ | 6-COOH | $-H$ |
| $-CH_3$ | $-CH_3$ | $5\text{-}OCH_3$ | $8\text{-}OCH_3$ |
| $-CH_3$ | $-CH_3$ | $-H$ | $-H$ |
| $-CH_3$ | $-CH_3$ | $-CH_3$ | $-H$ |
| $-CH_3$ | $-CH_3$ | $6\text{-}OCH_3$ | $-H$ |
| $-CH_3$ | $-CH_3$ | 6-OH | $-H$ |
| $-CH_3$ | $-CH_3$ | $6\text{-}SO_3H$ | $-H$ |

Further, it is possible to use pyrazines as dye bleach catalysts, such as pyrazine itself or pyrazines substituted by methyl, ethyl and/or carboxylic acid groups, such as 2-methylpyrazine, 2-ethylpyrazine, 2,3-, 2,5- or 2,6-dimethylpyrazine, pyrazinecarboxylic acid, pyrazine-2,3-, -2,5- or -2,6-dicarboxylic acid or 2,3-dimethylpyrazine-5,6-dicarboxylic acid.

Very suitable dye bleach catalysts are watersoluble quinoxalines with the following substituents: (a) a hydroxymethyl group in the 2-position and a hydroxymethyl group in the 3-position, and the following substituents on the benzene ring: 6-methoxy or 6,7-dimethoxy or 6-methoxy-7-acetylamino or [6,7-b-]-dioxolo or -dioxano, or (b) an acylated hydroxymethyl group in the 2-position and an acylated hydroxymethyl group in the 3-position and the following substituents on the benzene ring: 6,7-dimethoxy or 6-methoxy-7-acetylamino or 5-methoxy-6-chloro or 6-methoxy-5-chloro or [6,7-b]-dioxolo or -dioxano, or (c) a methyl group in the 2-position and a methyl group in the 3-position and no substituents, or the following substituents, on the benzene ring: monomethoxy or dimethoxy or methyl or 6-chloro or 5-hydroxy or 5,8-dihydroxy or 6-hydroxy or [5,6-b]-dioxolo or [6,7-b]-dioxano, or (d) a phenyl group in the 2-position and a phenyl group in the 3 -position and a sulphonic acid group in the 6-position.

At the same time, quinoxalines with the following substituents are preferred: (a) a hydroxymethyl group in the 2-position and a hydroxymethyl group in the 3-position and the following substituents on the benzene ring: 6-methoxy or 6,7-dimethoxy or [6,7-b]-dioxolo or -dioxano, or (b) an acylated hydroxymethyl group in the 2-position and an acylated hyroxymethyl group in the 3-position and a methoxy group in the 6-position and a methoxy group in the 7-position on the benzene ring, or (c) a methyl group in the 2-position and a methyl group in the 3-position and no substituents, or the following substituents, on the benzene ring: methyl or 6-hydroxy, or 5,8-dihyroxy.

Usable dye bleach catalyst are also described in German Auslegeschriften Nos. 2,010,707, 2,144,298 and 2,144,297, in French Patent Specification No. 1,489,460 and in U.S. Pat. No. 2,270,118.

As a strong acid, the bleach bath (2) preferably contains sulphuric acid or sulphamic acid.

An example of a possible oxidising agent is trimethylamine oxide. It is advantageous to use watersoluble nitro compounds, preferably aromatic mono- or dinitrosulphonic acids, such as 4-amino-3-nitrobenzene-1-sulphonic acid, 1-methyl-4-nitrobenzene-2-sulphonic acid or especially nitrobenzenesulphonic acids of the formula $$(2)\quad (O_2N-)_nC_6H_{(5-n)}-SO_3H$$

wherein $n$ is 1 or 2. The oxidising agents preferably have, at the pH value of the processing solution, a polarographic half-step potential of −150 to −250 millivolt relative to a silver chloride reference electrode. The use of oxidising agents for the purpose of influencing the colour equilibrium and the contrast of the images produced by the dye bleach process has already been described in German Patent Specification No. 735,672, in British Patent Specification Nos. 539,190 and 539,509 and in Japanese Patent Publication No. 22,673/69. However, all these cases relate to processing which is carried out without iodide. Furthermore, none of these patent specifications are concerned with a specifically high-speed processing method. Finally, in these previously described processes the important component of the anti-oxidant, without which stable baths cannot be obtained, is missing.

Organic mercapto compounds are advantageously used as anti-oxidants. It has proved particularly advantageous to use the compounds of the formulae $$(3)\quad HS-C_qH_{2q}-B \text{ or}$$

$$(4)\quad HS-(CH_2)_m-COOH$$

wherein $q$ denotes an integer of value from 2 to 12, B denotes a sulphonic acid group or carboxylic acid group and $m$ denotes one of the numbers 3 or 4. Mercapto compounds which can be used as anti-oxidants are described in DT-OS 2,258,076 and in Swiss Patent Application No. 7,124/73. The mercapto compounds, especially those of the above formula (3), that is to say ω-mercaptobutyric acid and ω-mercaptocaproic acid, not only provide good oxidation protection but in some cases also provide a marked anti-corrosive action. In general, attention should be given, when choosing the oxidising agents (c) and the anti-oxidants (d), to the fact that the latter should not be oxidised significantly by the former.

The pH value of the bleach bath (2) should be less than 2, and this can be achieved without difficulty through the presence of the previously mentioned sulphuric acid or sulphamic acid. The temperature of the bleach bath, and also of the other treatment baths, is 20° to 90°C. In general it is advantageous not to exceed 60°C, for example to work at 30° to 40°C. However, it is a further advantage of the process that it gives good images of normal colour equilibrium at elevated temperature, for example at 50°C or even above. The processing can be further shortened by raising the temperature, and even under these conditions the baths still remain stable for sufficiently long. The ratios of the substances (a), (b), (c) and (d) present in the bleach bath can be varied within rather wide limits and are suitably selected analogously to those of known methods. It is advantageous if the bleach baths contain the stated relatively high amount of 0.5 to 5 g of dye bleach catalyst per liter of bath liquid. Furthermore, the following quantity ranges may be mentioned as being suitable for the individual additives: 5 to 20 g of iodide (b), 0.1 to 30 g of oxidising agent (c) and 0.5 to 5 g of anti-oxidant (d) per liter of bleach bath (2).

The silver fixing bath can be formulated in a known and customary manner. For example, the fixing agent used is sodium thiosulphate or, advantageously, ammonium thiosulphate, if desired with additives such as sodium bisulphite and/or sodium metabisulphite.

The repetition of individual treatments (in each case in a further tank with a bath of the same composition as the preceding bath) within the framework of the particular time limit is possible, and in some cases better bath utilisation can be achieved thereby. If the number of available tanks and the time programme permit, it is also possible to employ water baths between baths of different action. However, in most cases it is advantageous to bring the material from the silver developing bath (1) directly into the combined bath (2), above all if the silver developing bath already contains dye bleach catalyst. All baths can contain additives such as hardeners, wetting agents, optical brighteners and UV stabilisers.

The process according to the invention can be employed, for example, and the production of positive colour images in automatic copying machines or automatic photographing machines or in the rapid processing of other silver dye bleach materials such as, for example, for scientific recordings and industrial purposes, for example colour screen photography.

The silver dye bleach material used can be a transparent, metallic-reflecting or, preferably, opaque white material, the carrier of which cannot absorb any liquid from the baths.

The carrier can consist, for example, of optionally pigmented cellulose triacetate or polyester. If it consists of paper felt, the latter must be lacquered, or polyethylene-coated, on both sides. On at least one side of this carrier are the light-sensitive layers, preferably in the known arrangement, that is to say with the lowest layer a red-sensitised silver halide emulsion layer containing cyan azo dyestuff, on top of this a green-sensitised silver halide emulsion layer which contains a magenta azo dyestuff, and the uppermost layer a blue-sensitive silver halide emulsion layer which contains a yellow azo dyestuff. The material can also contain base layers, intermediate layers, filter layers and protective layers, but the total thickness of the layers should as a rule not exceed 20 μ.

Advantages of the present process compared to the known state of the art have already been mentioned. Summarising, it can be said that the process proves advantageous in particular because it does not require any thiourea, because fluctuations which can occur during processing, have relatively slight effects, because it gives a particularly good image quality with flat gradation without losses in sensitivity, because it can use easily accessible chemicals and finally because it only requires a short time.

EXAMPLE 1

A photographic material with three colour layers, for the silver dye bleach process, is produced on a pigmented cellulose acetate carrier; the material contains, in the lowest, red-sensitive, layer, the cyan image dye stuff of the formula (5)

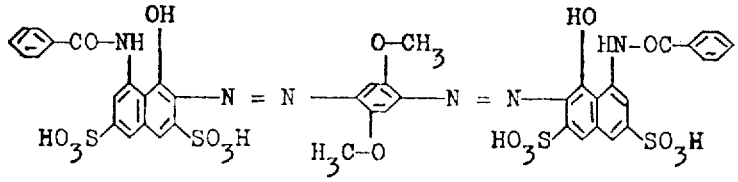

in the green-sensitive layer, on top of this, the magenta image dyestuff of the formula (6)

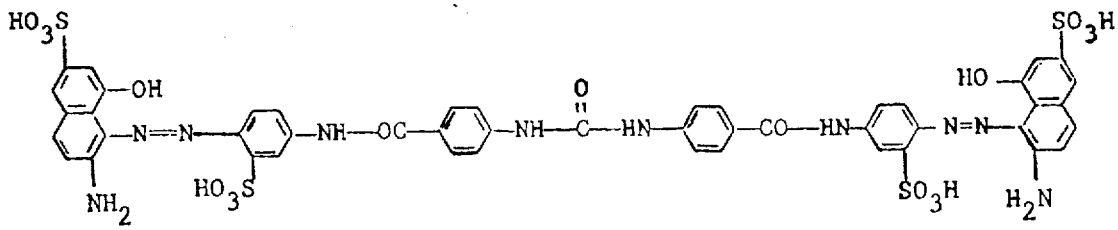

and, in the uppermost, blue-sensitive, layer the yellow image dyestuff of the formula (7)

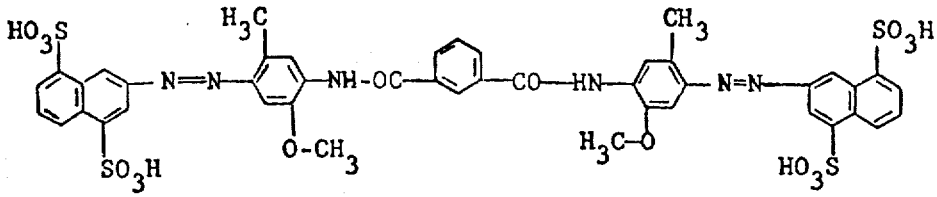

The image dyestuffs are incorporated so as to give the emulsions a reflectance density of D = 2.0. The colour layers containing a total of 0.8 g of Ag/m² are separated by gelatine layers, the total thickness being 15 μ.

This material is exposed in a reproduction camera and subsequently processed in a so-called roll processor. This apparatus consists of four tanks each of 2 liters capacity. The speed of the drive system is set so that the time of immersion per tank is 60 seconds. The exposed material passes through the four tanks containing the following processing solutions, the temperature of the baths being 35°C:

| | | |
|---|---|---|
| 1st tank - silver developing bath | | |
| Composition | | |
| Na polyphosphate | 1 | g/l |
| Anhydrous Na sulphite | 40 | g/l |
| Hydroquinone | 10 | g/l |
| Na metaborate | 20 | g/l |
| Na hydroxide | 3 | g/l |
| 1-Phenyl-3-pyrazolidone | 1 | g/l |
| Potassium bromide | 1.5 | g/l |
| Benzotriazole | 0.2 | g/l |
| Catalyst: | | |
| 2,3,6-Trimethylquinoxaline (added as a 1% strength solution in methylcellosolve) | 0.4 | g/l |
| 2nd tank - bleach bath | | |
| Composition | | |
| 96% strength sulphuric acid | 20 | ml/l |
| 4-Mercaptobutyric acid | 1 | ml/l |
| Potassium iodide | 10 | g |
| Sodium m-nitrobenzenesulphonate | 7 | g |
| Catalyst: | | |
| 2,3,6-Trimethylquinoxaline | 2 | g |
| 3rd tank - fixing bath | | |
| Composition | | |
| Ammonium thiosulphate | 220 | g |
| Sodium metabisulphite | 10 | g |
| Sodium sulphite | 40 | g |
| 4th tank - soaking bath | | |
| Total processing time (including transport time from tank to tank, and using the same dwell time of about 1 minute in the individual tanks). | 5 | minutes |

After drying, reproductions of the depicted originals which are true to nature in colour and tonal values are obtained. With one filling of the tank, 40 to 60 images of size 18 cm × 24 cm, of practically constant quality, can be developed over the course of 14 days.

Even on continuous use of the combined bleach bath of the above composition, parts of the apparatus consisting of high quality stainless steel were not attacked visibly.

In certain types of processing machines in which the sheet-form material is passed through the baths between transport rollers, mechanical damage of the material can occur at elevated processing temperature, manifesting itself in local damage to the layers, especially along the edges. This disadvantage can be countered effectively by adding certain wetting agents to the baths. In the processing solutions of the preceding example, the following wetting agents are used with advantage:

1. In the silver developing bath (1):

0.2 g/liter of the perfluoro compound of the formula

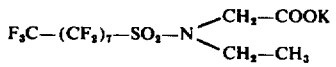

2. In the bleach bath (2)

0.12 g/liter of the compound of the formula $H_{25}C_{18}-(O-CH_2-CH_2)_{27}-OH$ 3. In the fixing bath (3):

0.08 g/liter of the same compound as in the bleach bath.

Similar results to those in the above example can be achieved if the composition of the developer bath (1) and of the bleach bath (2) is modified in accordance with the following table, but in other respects the above instruction is followed.

TABLE

| | Developer (1) Composition as indicated, apart from the catalyst: | Composition of catalyst: | Bleach bath (2) As indicated apart from added oxidising agent: |
|---|---|---|---|
| 1 | 0.6 g/l of 2,3-di-(hydroxymethyl-[6,7-b)-dioxoloquinoxaline | 1.2 g/l as for developer | 3 g/l of sodium m-nitrobenzene-sulphonate |
| 2 | 1 ml/l of 2,5-dimethylpyrazine | 3 ml/l as for developer | 0.5 g/l of sodium m-nitrobenzene-sulphonate |
| 3 | Without catalyst | 2.5 g/l of 2,3-dimethylquinoxaline | 0.4 g/l of sodium 2,4-dinitro-benzenesulphonate |
| 4 | 0.8 g/l of 2,3-dimethylquinoxaline-6-carboxylic acid | 0.5 g/l as for developer | 8 g/l of sodium m-nitrobenzene-sulphonate |
| 5 | 10 ml of a 1% strength solution of 2,3-dimethyl-6-methoxyquinoxaline in cellosolve | 2 g/l of 2,3-dimethyl-6-methoxyquinoxaline | 5 g/l of sodium m-nitrobenzene-sulphonate |

EXAMPLE 2

The photographic material contains the same layer dyestuffs as in Example 1 but is built up with double layers as follows (see DT-OS 2,036,918 and 2,132,836)

Blue-sensitive, colourless
Blue-sensitive yellow dyestuff (7)
Yellow filter
Green-sensitive, colourless
Green-sensitive magenta dyestuff (6)
Intermediate layer (gelatine)
Red-sensitive cyan dyestuff (5)
Red-sensitive, colourless
Carrier, opaque The image dyestuffs are cast so as to produce a reflectance density of D = 2.0. The total silver content of the 22 $\mu$ thick triple material is 2.0 g of Ag/m².

The material is exposed under a coloured diapositive in an enlarging apparatus. It is then processed in accordance with the following instructions (bath temperature 24°C):

1. Silver developing bath: 2 minutes
Composition as in Example 1)

2. Bleach bath: 4 minutes

| Composition | | |
|---|---|---|
| Sulphamic acid | 100 | g/l |
| Ascorbic acid | 2 | g/l |
| Ammonium iodide | 7 | g/l |
| Sodium m-nitrobenzenesulphonate | 10 | g/l |
| Catalyst: | | |
| 2,3,6-Trimethylquinoxaline | 3 | g/l |

3. Fixing bath: 4 minutes
Composition as in Example 1)

4. Soaking: 6 minutes

| | | |
|---|---|---|
| Total processing time | 16 | minutes |

After drying, a direct-viewing copy of the colour diapositive, which is true in colour and tonal values, is obtained.

Similar results can be obtained if sodium iodide is used instead of ammonium iodide in the bleach bath. Instead of ascorbic acid, other compounds of the type of the reductones, such as are described in DT-OS 1,924,723, can also be employed with good success as anti-oxidants.

EXAMPLE 3

A photographic material with three extremely thin colour layers for the silver dye bleach process is produced on a transparent polyester carrier; the material contains the dyestuffs of the composition indicated in Example 1 in the lowest, red-sensitive, layer, in the green-sensitive layer on top of this, and in the uppermost, blue-sensitive layer. The image dyestuffs are incorporated so as to give the emulsions a transmission density of D = 2.2. The colour layers, containing a total of 1.4 g of Ag/m², are separated by gelatine layers. The total thickness of the three-colour material is 7 82 .

This material is exposed in a microfilm camera, using flashlight. A coloured direct-viewing original is photographed in this camera with 20-fold size reduction, to an image size of 33 × 48 mm.

The exposed material is processed in a so-called spray method. This apparatus consists of three nozzles with a spray angle of 30°, by means of which the processing solutions are sprayed under a pressure of 2.3 bars onto the material to be processed. The distance from the nozzles to the photographic material is 9 cm. The processing pipelines are warmed to a temperature of 60°C. The following processing solutions and spraying times are used:

1. Silver developing bath, time: 20 seconds

| Composition | | |
|---|---|---|
| Sodium polyphosphate | 1 | g/l |
| Anhydrous sodium sulphite | 50 | g/l |
| Hydroquinone | 5 | g/l |
| Sodium metaborate | 15 | g/l |
| 1-Phenyl-3-pyrazolidone | 0.2 | g/l |
| Potassium bromide | 3 | g/l |
| Benztriazole | 0.4 | g/l |

2. Bleach bath, time: 45 seconds

| Composition | | |
|---|---|---|
| Sulphuric acid | 20 | ml/l |
| Thioglycerol | 1 | ml/l |
| Sodium iodide | 20 | g/l |
| Sodium m-nitrobenzenesulphonate | 2.5 | g/l |
| Catalyst: | | |
| 2,3-Dimethyl-6-methoxy-quinoxaline | 2 | g/l |

3. Fixing bath, time: 45 seconds
Composition as in Example 1)

4. Soaking, time: 60 seconds

| | | |
|---|---|---|
| Total processing time | 170 | seconds |

After drying, a coloured diapositive is obtained, which reproduces the photographed original greatly reduced in size, but true to nature in colour and tonal values.

What we claim is:

1. Method for processing silver dye bleach materials, including the following process measures 1. silver developing,
2. dye bleaching and silver bleaching,
3. silver fixing and
4. soaking, which method comprises using treatment baths corresponding to the treatment stages (1) to (4), and following the sequence (1) to (4), a bleaching bath (2) being used, for the combined dye bleaching and silver bleaching, which contains a. a strong acid,
b. a water-soluble iodide,
c. as a water-soluble oxidising agent a water-soluble organic nitro compound,
d. as an anti-oxidant a water-soluble mercapto compound and
e. as a dye bleach catalyst, in an amount of 0.5 to 5 gram per libre, a pyrazine or quinoxaline compound which is water-soluble both in an alkaline and in an acid medium and has an absorption maximum of less than 450 mm, and that the entire processing, from entry into the first bath (1) to leaving the last bath (4) takes place at temperatures from 20° to 90°C.

2. Process according to claim 1, wherein the silver developing bath (1) also contains a dye bleach catalyst.

3. Process according to claim 2 which comprises using the same catalyst in baths (1) and (2).

4. Process according to claim 1, wherein the bleach bath (2) contains sulphuric acid or sulphamic acid.

5. Process according to claim 1, wherein the material to be processed passes directly from the silver developing bath (1) into the bleach bath (2).

6. Process according to claim 1, wherein the water-soluble dye bleach catalyst used is a quinoxaline with the following substituents: (a) a hydroxymethyl group in the 2-position and a hydroxymethyl group in the 3-position, and the following substituents on the benzene ring: 6-methoxy or 6,7-dimethoxy or 6-methoxy-7-acetylamino or [6,7-b-]-dioxolo or -dioxano, or (b) an acylated hydroxymethyl group in the 2-position and an acylated hydroxymethyl group in the 3-position and the following substituents on the benzene ring: 6,7-dimethoxy or 6-methoxy-7-acetylamino or 5-methoxy-6-chloro or 6-methoxy-5-chloro or [6,7-b]-dioxolo or -dioxano, or (c) a methyl group in the 2-position and a methyl group in the 3-position and no substituents, or the following substituents, on the benzene ring: monomethoxy or dimethoxy or methyl or 6-chloro or 5-hydroxy or 5,8-dihydroxy or 6-hydroxy or [5,6-b]-dioxolo or [6,7-b]-dioxano, or (d) a phenyl group in the 2-position and a phenyl group in the 3-position and a sulphonic acid group in the 6-position, whilst mono- or poly-nitrobenzenesulphonic acids are employed as oxidising agents and compounds of the formula $HS—A(—B)_m$, wherein A denotes an aliphatic, cycloaliphatic, araliphatic, aromatic or heterocyclic bridge member, B denotes a radical which confers solubility in water and *m* denotes an integer of at most 4, are employed as anti-oxidants.

7. Process according to claim 1, wherein a quinoxaline with the following substituents is used as the water-soluble quinoxaline compound: (a) a hydroxymethyl group in the 2-position and a hydroxymethyl group in the 3-position and the following substituents on the benzene ring: 6-methoxy or [6,7-b]-dioxolo or -dioxano, or (b) an acylated hydroxymethyl group in the 2-position and an acylated hydroxymethyl group in the 3-position and a methoxy group in the 6-position and a methoxy group in the 7-position on the benzene ring, or (c) a methyl group in the 2-position and a methyl group in the 3-position and no substituents, or the following substituents, on the benzene ring: methyl or 6-hydroxy or 5,8-dihydroxy, whilst compounds of the formula $(O_2N)_n—C_6H_{(5-n)}—SO_3H$, wherein *n* is 1, 2 or 3, are used as oxidising agents and compounds of the formula $H—S—C_qH_{2q}—B$, wherein *q* denotes an integer of value from 2 to 12, and B denotes a sulphonic acid group or carboxylic acid group, are used as anti-oxidants.

8. Process according to claim 1, wherein the oxidising agent used is a compound of the formula $(O_2N-)_n—C_6H_{(5-n)}—SO_3H$, wherein *n* is 1 or 2 and the anti-oxidant used is a compound of the formula $HS—(CH_2-)_m—COOH$, wherein *m* is 3 or 4.

9. Process according to claim 1 o- or m-nitrobenzenesulphonic acid is used as the oxidising agent.

10. Process according to claim 1, wherein the total processing from entry into the first bath (1) to leaving the last bath lasts at most 6 minutes and the dwell time in the individual baths amounts to a most 2 minutes.

* * * * *